US011225394B1

(12) United States Patent
Cooper

(10) Patent No.: US 11,225,394 B1
(45) Date of Patent: Jan. 18, 2022

(54) MOTORIZED HOSE REEL

(71) Applicant: Nathan Cooper, Cedar Grove, NJ (US)

(72) Inventor: Nathan Cooper, Cedar Grove, NJ (US)

( * ) Notice: Subject to any disclaimer, the term of this patent is extended or adjusted under 35 U.S.C. 154(b) by 0 days.

(21) Appl. No.: 16/807,276

(22) Filed: Mar. 3, 2020

(51) Int. Cl.
*B65H 75/44* (2006.01)

(52) U.S. Cl.
CPC ..... *B65H 75/4486* (2013.01); *B65H 75/4478* (2013.01); *B65H 75/4484* (2013.01); *B65H 2701/33* (2013.01); *B65H 2701/332* (2013.01)

(58) Field of Classification Search
CPC ..... B65H 75/4478; B65H 75/4484; B65H 75/4486; B65H 2701/33; B65H 2701/332; B65H 2701/333; Y10T 137/6918
See application file for complete search history.

(56) References Cited

U.S. PATENT DOCUMENTS

| | | | | |
|---|---|---|---|---|
| 4,012,002 | A | 3/1977 | McDonald | |
| 4,513,772 | A | 4/1985 | Fisher | |
| 4,793,376 | A | 12/1988 | Hare | |
| D326,549 | S | 5/1992 | Whitehead | |
| 7,182,274 | B2 * | 2/2007 | Nies | B65H 75/403 239/198 |
| 7,316,368 | B2 | 1/2008 | Moon | |
| 7,503,338 | B2 * | 3/2009 | Harrington | A01G 25/162 137/355.16 |
| 7,931,225 | B2 | 4/2011 | Wang | |
| 8,141,571 | B2 * | 3/2012 | Granger | B65H 75/403 137/1 |
| 8,336,800 | B1 | 12/2012 | Lopez | |
| 8,360,353 | B2 | 1/2013 | Mosher | |
| 9,079,748 | B2 * | 7/2015 | Tracey | F16L 55/07 |
| 10,472,202 | B2 * | 11/2019 | Lee | B65H 75/4484 |
| 2008/0023579 | A1 | 1/2008 | Leonard | |
| 2015/0129703 | A1 | 5/2015 | Kucera | |
| 2019/0248621 | A1 * | 8/2019 | Tracey | B65H 75/4486 |

* cited by examiner

*Primary Examiner* — Kevin F Murphy
(74) *Attorney, Agent, or Firm* — Kyle A. Fletcher, Esq.

(57) ABSTRACT

The motorized hose reel is a storage device. The motorized hose reel is configured for use with a hose. The motorized hose reel stores the hose. The motorized hose reel deploys the hose for use. The motorized hose reel retracts the hose for storage. The motorized hose reel comprises a hose structure, a spool structure, a control circuit, and a personal data device. The spool structure stores the hose structure. The control circuit is an electrically powered device. The control circuit deploys the hose structure from the spool structure for use. The control circuit retracts onto the spool structure for storage. The personal data device controls the operation of the control circuit.

19 Claims, 5 Drawing Sheets

MOTORIZED HOSE REEL

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transportation and packing including reels to store filamentary materials, more specifically, an arrangement to drive a hose reel. (B65H75/30)

SUMMARY OF INVENTION

The motorized hose reel is a storage device. The motorized hose reel is configured for use with a hose. The motorized hose reel stores the hose. The motorized hose reel deploys the hose for use. The motorized hose reel retracts the hose for storage. The motorized hose reel comprises a hose structure, a spool structure, a control circuit, and a personal data device. The spool structure stores the hose structure. The control circuit is an electrically powered device. The control circuit deploys the hose structure from the spool structure for use. The control circuit retracts onto the spool structure for storage. The personal data device controls the operation of the control circuit.

These together with additional objects, features and advantages of the motorized hose reel will be readily apparent to those of ordinary skill in the art upon reading the following detailed description of the presently preferred, but nonetheless illustrative, embodiments when taken in conjunction with the accompanying drawings.

In this respect, before explaining the current embodiments of the motorized hose reel in detail, it is to be understood that the motorized hose reel is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the motorized hose reel. It is therefore important that the claims be regarded as including such equivalent construction insofar as they do not depart from the spirit and scope of the motorized hose reel. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
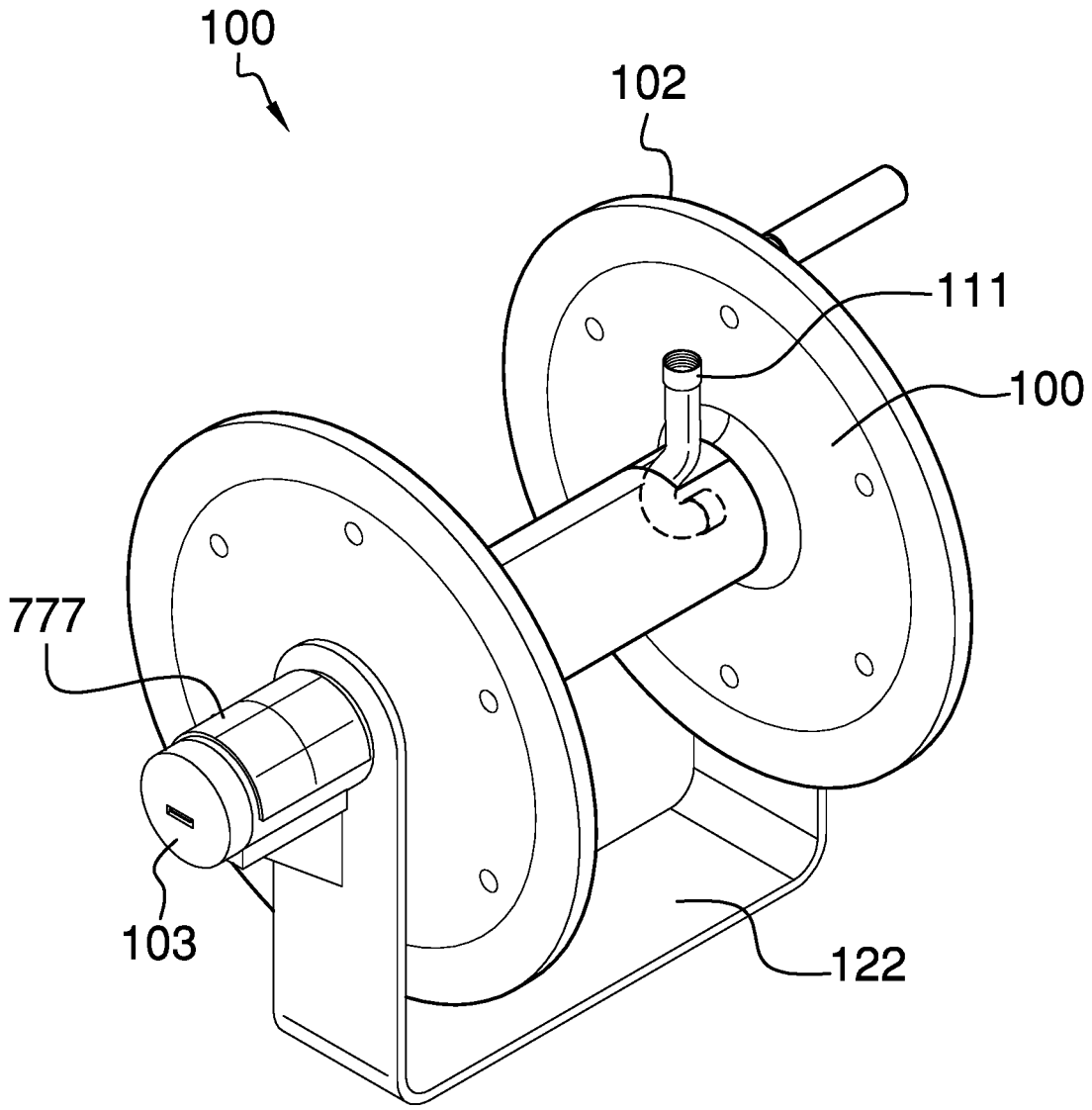
FIG. 1 is a perspective view of an embodiment of the disclosure.
Figure 2:
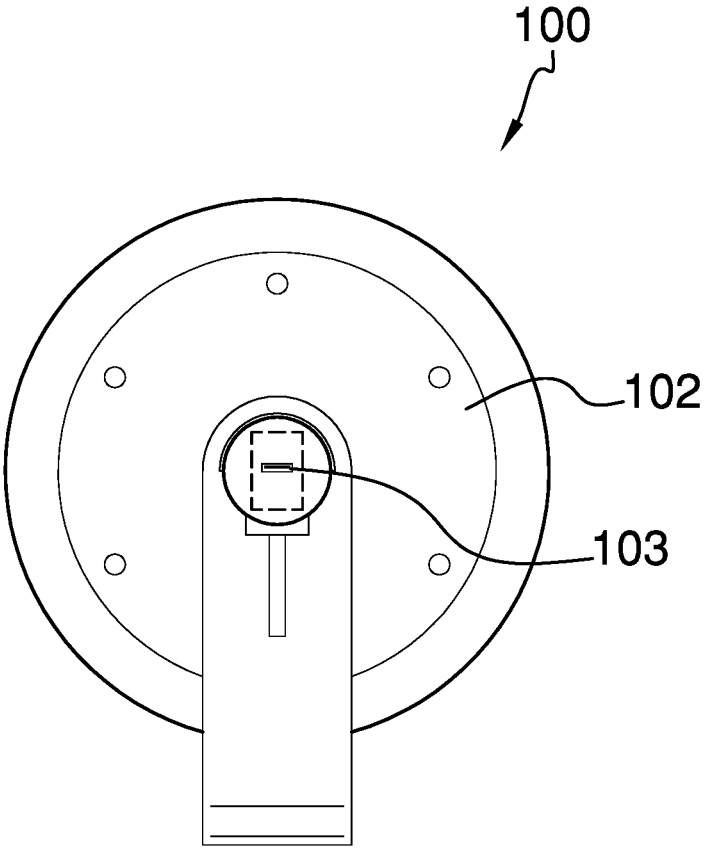
FIG. 2 is a side view of an embodiment of the disclosure.
Figure 3:
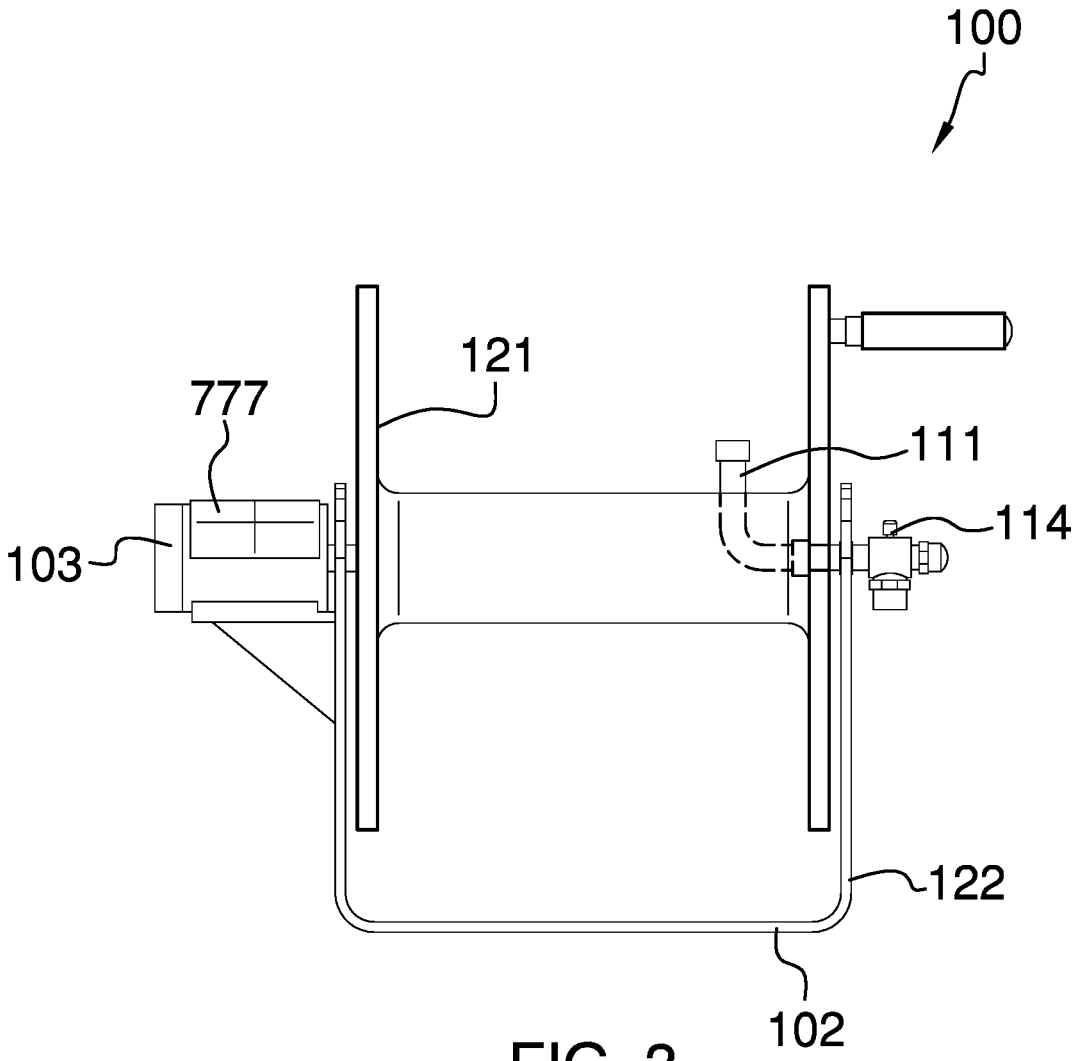
FIG. 3 is a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The motorized hose reel 100 (hereinafter invention) is a storage device. The invention 100 is configured for use with a hose 113. The invention 100 stores the hose 113. The invention 100 deploys the hose 113 for use. The invention 100 retracts the hose 113 for storage. The invention 100 comprises a hose 113 structure 101, a spool 121 structure 102, a control circuit 103, and a personal data device 104. The spool 121 structure stores the hose 113 structure 101. The control circuit 103 is an electrically powered device. The control circuit 103 deploys the hose 113 structure 101 from the spool 121 structure 102 for use. The control circuit 103 retracts onto the spool 121 structure 102 for storage. The personal data device 104 controls the operation of the control circuit 103.

The control circuit 103 establishes a wireless communication link 137 with the personal data device 104 that allows the personal data device 104 to remotely control the control circuit 103. The personal data device 104 is a programmable electrical device that provides data management and communication services through one or more functions referred to as an application 105. The application 105 is a set of logical operating instructions that are performed by the personal data device 104. The addition of an application 105 will provide increased functionality for the personal data device 104. This disclosure assumes that an application 105 exists for the purpose of interacting with the control circuit 103. Methods to design and implement an application 105 on a personal data device 104 are well known and documented in the electrical arts. The personal data device 104 further comprises an application 105.

The hose 113 structure 101 is a mechanical structure. The hose 113 structure 101 is a fluid transport mechanism. The hose 113 structure 101 is configured to attach to a source of a fluid under pressure. The hose 113 structure 101 is configured to attach to a discharge structure that controls the flow of liquid through the hose 113 structure 101. The hose 113 structure 101 is configured to release pressure variations within the fluid contained in the hose 113 structure 101 to release the pressure when the hose 113 structure 101 is retracted. The hose 113 structure 101 comprises a first fitting 111, a second fitting 112, a hose 113, and a relief valve 114.

The first fitting 111 is a fitting that attaches to a first open congruent end of the prism structure of the hose 113. The first fitting 111 forms a fluidic connection between the hose 113 and a source of fluid that is maintained under pressure. The first fitting 111 mounts on the spool 121 of the spool 121 structure 102 such that the first fitting 111 further secures to the hose 113. The second fitting 112 is a fitting that attaches to a second open congruent end of the prism structure of the hose 113. The second fitting 112 attaches the hose 113 to a device that controls the discharge of the fluid from the hose 113.

The hose 113 is a flexible tubular structure. The hose 113 has the shape of a prism. The hose 113 is a fluid transport device that transfers fluid between the first fitting 111 and the second fitting 112. The hose 113 is the physical structure that deploys from and retracts onto the spool 121 structure 102. The relief valve 114 is a valve. The relief valve 114 attaches to the first fitting 111. The relief valve 114 forms a controlled flow path between the interior space of the hose 113 and the exterior of the hose 113. The relief valve 114 is configured for use in the long term storage of the hose 113 on the spool 121 structure 102. The relief valve 114 is opened during the storage of the hose 113 such that changes in the external temperature do not cause pressure changes within the interior space of the hose 113 that can potentially damage the hose 113. The terms hose 113, fitting, and valve are defined elsewhere in this disclosure.

The spool 121 structure 102 is a mechanical structure. The spool 121 structure 102 is a cylindrical structure. The spool 121 structure 102 is a rotating structure. The rotation of the spool 121 structure 102 in a first direction deploys the hose 113 structure 101 from the spool 121 structure 102 for storage. The rotation of the spool 121 structure 102 in a second direction retracts the hose 113 structure 101 onto the spool 121 structure 102 for use in transporting a fluid. The spool 121 structure 102 comprises a spool 121 and a spool 121 bracket 122. The spool 121 is a cylindrical structure. The spool 121 forms the structure that stores the hose 113 when the hose 113 is not in use. The spool 121 is a rotating structure. The spool 121 rotates in the first direction such that the hose 113 deploys directly from the spool 121. The spool 121 rotates in the second direction such that the hose 113 retracts directly onto the spool 121. The spool 121 bracket 122 is a mechanical structure. The spool 121 bracket 122 forms a load path from the spool 121 to a fixed structure such that the spool 121 is elevated above a supporting surface. The spool 121 bracket 122 attaches the spool 121 to the fixed structure such that the spool 121 rotates freely.

The control circuit 103 is an electromechanical device. The control circuit 103 is a remotely controlled device. The control circuit 103 is an electrically powered device. The control circuit 103 mechanically deploys the hose 113 structure from the spool 121 structure 102. The control circuit 103 mechanically retracts the hose 113 structure 101 onto the spool 121 structure 102. The control circuit 103 establishes a wireless communication link 137 with the personal data device 104 that allows the personal data device 104 to remotely control the control circuit 103. The control circuit 103 comprises a logic module 131, a communication module 132, a master switch 133, a relay circuit 134, an electric motor 135, and a power circuit 136. The logic module 131, the communication module 132, the master switch 133, the relay circuit 134, the electric motor 135, and the power circuit 136 are electrically interconnected.

The control circuit 103 is an independently powered electric circuit. By independently powered is meant that the control circuit 103 can operate without an electrical connection to an external power source.

The logic module 131 is a readily and commercially available programmable electronic device that is used to manage, regulate, and operate the control circuit 103. Depending on the specific design and the selected components, the logic module 131 can be a separate component within the control circuit 103 or the functions of the logic module 131 can be incorporated into another component within the control circuit 103. The communication module 132 is a wireless electronic communication device that allows the logic module 131 to wirelessly communicate with a locally presented personal data device 104. Specifically, the communication module 132 establishes a wireless communication link 137 between the control circuit 103 and the personal data device 104. In the first potential embodiment of the disclosure, the communication module 132 supports a communication protocol selected from the group consisting of a WiFi™ protocol or a Bluetooth™ protocol. The logic module 131 controls the operation of the relay circuit 134. Specifically, the logic module 131 controls the operation of both the master relay 141 and the dpdt relay 142. Upon receipt of a first instruction from the personal data device 104 through the communication module 132, the logic module 131 configures the relay circuit 134 to rotate the electric motor 135 in the first direction in order to deploy the hose 113. Upon receipt of a second instruction from the personal data device 104 through the communication module 132, the logic module 131 configures the relay circuit 134 to rotate the electric motor 135 in the second direction in order to retract the hose 113.

The master switch 133 is an electric switch. The master switch 133 is a manually controlled switch. The master switch 133 controls the flow of electric power from the power circuit into the relay circuit 134. The master switch 133 disables the operation of the relay circuit 134 to deploy and retract the hose 113. The master switch 133 comprises a first lead 161 and a second lead 162.

The logic module 131 controls the operation of the relay circuit 134. The logic module 131 controls the operation of the electric motor 135 by controlling the operation of the relay circuit 134. By controlling the operation of the electric motor 135 is meant that the logic module 131 controls the direction of rotation of the electric motor 135. The relay circuit 134 comprises a master relay 141 and a dpdt relay 142.

The master relay 141 is a single pole single throw switch. The master relay 141 forms an electrical connection between the master switch 133 and the dpdt relay 142. The master relay 141 controls the flow of electric power from the master switch 133 into the dpdt relay 142. The logic module 131 controls the master relay 141. The logic module 131 closes the master relay 141 in order to enable the operation of the electric motor 135. The logic module 131 opens the master relay 141 in order to disable the operation of the electric motor 135. The master relay 141 comprises a third lead 163 and a fourth lead 164.

The dpdt relay 142 is a double pole double throw switch. The dpdt relay 142 forms an electrical connection between the master relay 141 and the electric motor 135. The logic module controls the operation of the dpdt relay 142. The logic module 131 shifts the position of the dpdt relay 142 between a first electrical setting and a second electrical setting. By setting the dpdt relay 142 in the first electrical setting while simultaneously setting the master relay 141 to the closed position, the logic module 131 causes the electric motor 135 to rotate in the first direction. By setting the dpdt relay 142 in the second electrical setting while simultaneously setting the master relay 141 to the closed position, the logic module 131 causes the electric motor 135 to rotate in the second direction. The dpdt relay switch 142 comprises a fifth lead 165, a sixth lead 166, a seventh lead 167, an eighth lead 168, a ninth lead 169, and a tenth lead 170.

The electric motor 135 is an electrically powered device. The electric motor 135 converts electrical energy received from the power circuit 136 into rotational mechanical energy. The electric motor 135 attaches directly to the spool 121 structure 102 such that the rotation of the electric motor 135 rotates the spool 121 of the spool 121 structure 102. The terms the logic module 131, the electric motor 135, the switch, and the relay are defined elsewhere in this disclosure. The electric motor 135 comprises an eleventh lead 171 and a twelfth lead 172.

The power circuit 136 is an electrical circuit. The power circuit 136 powers the operation of the control circuit 103. The power circuit 136 is an electrochemical device. The power circuit 136 converts chemical potential energy into the electrical energy required to power the control circuit 103. The power circuit 136 comprises a battery 151, a diode 152, and a photovoltaic cell 153. The power circuit 136 may be connected to at least one solar cell 777. The battery 151, the diode 152, and the photovoltaic cell 153 are electrically interconnected. The battery 151 comprises a first positive terminal 181 and a first negative terminal 191. The photovoltaic cell 153 comprises a second positive terminal 182 and a second negative terminal 192.

The battery 151 is an electrochemical device. The battery 151 converts chemical potential energy into the electrical energy used to power the control circuit 103. The battery 151 is a commercially available rechargeable battery 151. The photovoltaic cell 153 is an electrical device that converts light into electrical energy. The chemical energy stored within the rechargeable battery 151 is further renewed and restored through the use of the photovoltaic cell 153. The photovoltaic cell 153 is directly wired to the battery 151. The photovoltaic cell 153 is an electrical circuit that reverses the polarity of the rechargeable battery 151 and provides the energy necessary to reverse the chemical processes that the rechargeable battery 151 initially used to generate the electrical energy. This reversal of the chemical process creates a chemical potential energy that will later be used by the rechargeable battery 151 to generate electricity.

The diode 152 is an electrical device that allows current to flow in only one direction. The diode 152 installs between the rechargeable battery 151 and the photovoltaic cell 153 such that electricity will not flow from the first positive terminal 181 of the rechargeable battery 151 into the second positive terminal 182 of the photovoltaic cell 153. The photovoltaic cell 153 is defined elsewhere in this disclosure.

The assembly of the invention 100 are described in the following two paragraphs.

The first lead 161 of the master switch 133 electrically connects to the first positive terminal 181 of the battery 151. The second lead 162 of the master switch 133 electrically connects to the third lead 163 of the master relay 141. The fourth lead 164 of the master relay 141 electrically connects to the fifth lead 165 of the dpdt relay 142. The sixth lead 166 of the dpdt relay 142 electrically connects to the eleventh lead of the electric motor 135. The seventh lead 167 of the dpdt relay 142 electrically connects to the twelfth lead 172 of the electric motor 135. The eighth lead 168 of the dpdt relay 142 electrically connects to the first negative terminal 191 of the battery 151. The ninth lead 169 of the dpdt relay 142 electrically connects to the seventh lead 167 of the dpdt relay 142. The tenth lead 170 of the dpdt relay 142 electrically connects to the sixth lead 166 of the dpdt relay 142.

The dpdt relay 142 forms a set of electrical connections selected from the group consisting of: a) a first electrical setting that electrically connects the fifth lead 165 to the sixth lead 166 while simultaneously connecting the eighth lead 168 to the ninth lead 169; and, 2) b) a second electrical setting that electrically connects the fifth lead 165 to the seventh lead 167 while simultaneously connecting the eighth lead to the tenth lead 170.

In the first electrical setting, electric power is routed to the electric motor 135 such that the electric motor 135 rotates in a first direction. In the second electrical setting, electric power is routed to the electric motor 135 such that the electric motor 135 rotates in a second direction that is the reverse of the first direction.

Figure 4:
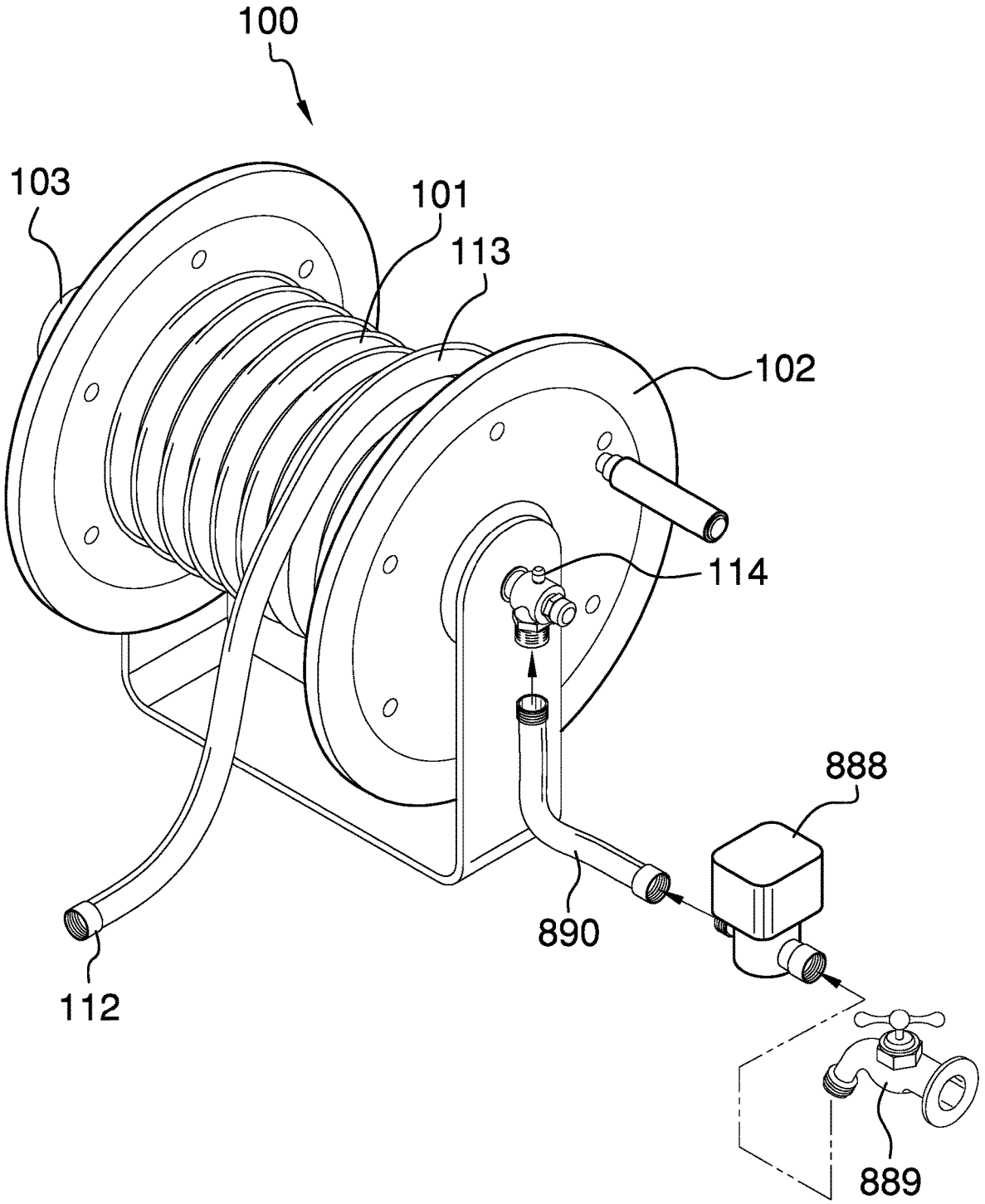
FIG. 4 is an in-use view of an embodiment of the disclosure.
Figure 5:
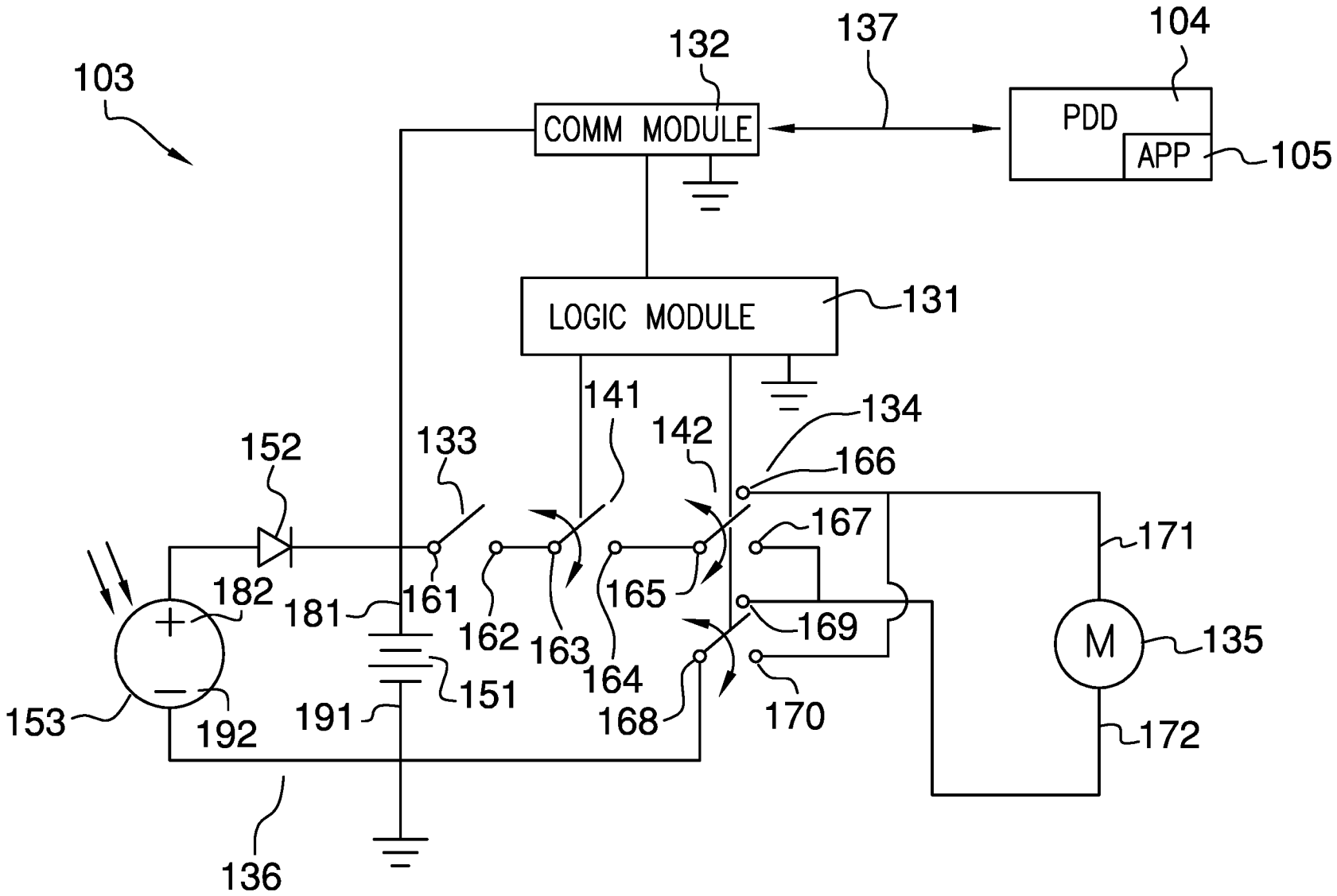
FIG. 5 is a schematic view of an embodiment of the disclosure.

Referring to FIG. 4, the invention 100 may include a programmable spigot control module 888, which are commercially available. The programmable spigot control module 888 connects between a spigot 889 and a feeder hose 890. The feeder hose 890 connects to the relief valve 114.

The following definitions were used in this disclosure:

Application or App: As used in this disclosure, an application or app is a self-contained piece of software that is especially designed or downloaded for use with a personal data device.

Battery: As used in this disclosure, a battery is a chemical device consisting of one or more cells, in which chemical energy is converted into electricity and used as a source of power. Batteries are commonly defined with a positive terminal and a negative terminal.

Bluetooth™: As used in this disclosure, Bluetooth™ is a standardized communication protocol that is used to wirelessly interconnect electronic devices.

Bracket: As used in this disclosure, a bracket is a mechanical structure that attaches a second structure to a first structure such that the load path of the second structure is fully transferred to the first structure.

Control Circuit: As used in this disclosure, a control circuit is an electrical circuit that manages and regulates the behavior or operation of a device.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk.

In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Exterior: As used in this disclosure, the exterior is used as a relational term that implies that an object is not contained within the boundary of a structure or a space.

External Power Source: As used in this disclosure, an external power source is a source of the energy that is externally provided to enable the operation of the present disclosure. Examples of external power sources include, but are not limited to, electrical power sources and compressed air sources.

Fitting: As used in this disclosure, a fitting is a component that attaches a first object to a second object. The fitting is often used to forming a fluidic connection between the first object and the second object.

Flexible: As used in this disclosure, flexible refers to an object or material that will deform when a force is applied to it but that will not necessarily return to its original shape when the deforming force is removed. GHT: As used in this disclosure, GHT refers to a standard Garden Hose Thread. The GHT is a threaded connection standard that is used in the United States for attaching a garden hose to a water supply or for attaching a one of a plurality of attachments to the garden hose.

Hose: As used in this disclosure, a hose is a flexible hollow prism-shaped device that is used for transporting liquids and gases. When referring to a hose in this disclosure, the terms inner dimension and outer dimension are used as they would be used by those skilled in the plumbing arts.

Interior: As used in this disclosure, the interior is used as a relational term that implies that an object is contained within the boundary of a structure or a space.

Lead: As used in this disclosure, a lead is a conductor that is physically used to electrically connect an electrical component into a larger circuit assembly.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Maintained Switch: A used in this disclosure, a maintained switch is a switch that maintains the position that was set in the most recent switch actuation. A maintained switch works in an opposite manner to a momentary switch.

Motor: As used in this disclosure, a motor refers to the method of transferring energy from an external power source into rotational mechanical energy.

Mount: As used in this disclosure, a mount is a mechanical structure that attaches or incorporates a first object to a second object.

PDD: As used in this disclosure, PDD is an acronym for personal data device.

Personal Data Device: As used in this disclosure, a personal data device is a handheld logical device that is used for managing personal information and communication. Examples of personal data device include, but are not limited to, cellular phones, tablets, and smartphones. See logical device Photovoltaic Cell: As used in this disclosure, a photovoltaic cell is a photoelectric device that directly converts light energy into electrical energy.

Plug: As used in this disclosure, a plug is an electrical termination that electrically connects a first electrical circuit to a second electrical circuit or a source of electricity. As used in this disclosure, a plug will have two or three metal pins.

Poles, Throws, and Switches: As used in this disclosure, the terms pole and throw are descriptions associated with an electrical switch. A pole refers to an electrical circuit the switch feeds electrical current into. The number of poles associated with the switch refers to the maximum number of independent circuits a switch can theoretically support. Because the circuits supported by the poles of a switch can be interconnected, a switch will often support fewer independent electrical circuits than the actual number of poles. The number of throws associated with a switch refers to the maximum number of electrical connections that can be made within an individual pole of the switch.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relay: As used in this disclosure, a relay is an automatic electronic, electromagnetic or electromechanical device that reacts to changes in voltage or current by opening or closing a switch in an electric circuit. Relays are further defined with a coil and a switch. Applying a voltage to the coil, usually referred to as energizing the coil, will cause the coil to change the position of the switch. This definition is not intended to preclude the substitution of a transistor for a relay. Within this disclosure, a transistor can be considered as a relay. In this scenario, the base voltage is analogous to the coil of the relay and the current flow from the collector to the emitter is analogous to the operation of the switch of the relay. Those skilled in the electrical arts will recognize that this substitution can be made without undue experimentation. The transistor is defined in greater detail elsewhere in this disclosure.

Remote Control: As used in this disclosure, remote control means the establishment of control of a device from a distance. Remote control is generally accomplished through the use of an electrical device that generates electrically based control signals that are transmitted via radio frequencies or other means to the device.

Spool: As used in this disclosure, a spool is a cylindrical device upon which a flexible material, including but not limited to a yarn, a cord, or a tape, can be wound. Depending on context, a spool may also contain the flexible material stored upon the spool.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation. Transistor: As used in this disclosure, a transistor is a general term for a three terminal semiconducting electrical device that is used for electrical signal amplification and electrical switching applications. There are several designs of transistors. A common example of a transistor is an NPN transistor that further comprises a collector terminal, an emitter terminal, and a base terminal and which consists of a combination of two rectifying junctions (a diode is an example of a rectifying junction). Current flowing from the collector terminal through the emitter terminal crosses the two rectifier junctions. The amount of the electric current crossing the two rectified junctions is controlled by the amount of electric current that flows through the base terminal. This disclosure assumes the use of an NPN transistor. This assumption is made solely for the purposes of simplicity and clarity of exposition. Those skilled in the electrical arts will recognize that other types of transistors, including but not limited to, field effect transistors and PNP transistors, can be substituted for an NPN transistor without undue experimentation.

Valve: As used in this disclosure, a valve is a device that is used to control the flow of a fluid (gas or liquid) through a pipe, tube, or hose.

WiFi™: As used in this disclosure, WiFi™ refers to the physical implementation of a collection of wireless electronic communication standards commonly referred to as IEEE 802.11x. With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed:

1. A motorized hose reel comprising
a hose structure, a spool structure, a control circuit, and a personal data device;
wherein the spool structure stores the hose structure;
wherein the control circuit deploys the hose structure from the spool structure for use;
wherein the personal data device controls the operation of the control circuit;
wherein the motorized hose reel is a storage device;
wherein the motorized hose reel stores the hose structure;
wherein the motorized hose reel deploys the hose structure for use;
wherein the motorized hose reel retracts the hose structure for storage;
wherein the hose structure comprises a first fitting, a second fitting, a hose, and a relief valve;
wherein the hose is a flexible tubular structure;
wherein the hose has the shape of a prism;
wherein the first fitting is a fitting that attaches to a first open congruent end of the prism structure of the hose;
wherein the second fitting is a fitting that attaches to a second open congruent end of the prism structure of the hose;
wherein the relief valve attaches to the first fitting.

2. The motorized hose reel according to claim 1
wherein the control circuit is an electromechanical device;
wherein the control circuit is a remotely controlled device;
wherein the control circuit is an electrically powered device.

3. The motorized hose reel according to claim 2
wherein the hose structure is a mechanical structure;
wherein the hose structure is a fluid transport mechanism;
wherein the hose structure is configured to attach to a source of a fluid under pressure;
wherein the hose structure is configured to attach to a discharge structure that controls the flow of liquid through the hose structure;
wherein the hose structure is configured to release pressure variations within the fluid contained in the hose structure created by a change in temperature.

4. The motorized hose reel according to claim 3
wherein the spool structure is a mechanical structure;
wherein the spool structure is a cylindrical structure;
wherein the spool structure is a rotating structure;
wherein the rotation of the spool structure in a first direction deploys the hose structure from the spool structure for use in transporting fluid;
wherein the rotation of the spool structure in a second direction retracts the hose structure onto the spool structure for storage.

5. The motorized hose reel according to claim 4
wherein the control circuit mechanically deploys the hose structure from the spool structure;
wherein the control circuit mechanically retracts the hose structure onto the spool structure;
wherein the control circuit establishes a wireless communication link with the personal data device that allows the personal data device to remotely control the control circuit.

6. The motorized hose reel according to claim 5
wherein the control circuit is an independently powered electric circuit;

wherein the control circuit operates without an electrical connection to an external power source.

7. The motorized hose reel according to claim 6 wherein the spool structure comprises a spool and a spool bracket;

wherein the spool forms the structure that stores the hose;

wherein the spool bracket forms a load path from the spool to a fixed structure such that the spool is elevated above a supporting surface.

8. The motorized hose reel according to claim 7 wherein the control circuit comprises a logic module, a communication module, a master switch, a relay circuit, an electric motor, and a power circuit;

wherein the logic module, the communication module, the master switch, the relay circuit, the electric motor, and the power circuit are electrically interconnected.

9. The motorized hose reel according to claim 8 wherein the first fitting mounts on the spool of the spool structure such that the first fitting secures to the hose;

wherein the second fitting attaches the hose to a device that controls the discharge of the fluid from the hose.

10. The motorized hose reel according to claim 9 wherein the hose is a fluid transport device that transfers fluid between the first fitting and the second fitting;

wherein the hose is the physical structure that deploys from and retracts onto the spool structure.

11. The motorized hose reel according to claim 10 wherein the relief valve is a valve;

wherein the relief valve forms a controlled flow path between the interior space of the hose and the exterior of the hose.

12. The motorized hose reel according to claim 11 wherein the spool is a cylindrical structure;

wherein the spool is a rotating structure;

wherein the spool rotates in the first direction such that the hose deploys directly from the spool;

wherein the spool rotates in the second direction such that the hose retracts directly onto the spool;

wherein the spool bracket is a mechanical structure;

wherein the spool bracket attaches the spool to the fixed structure such that the spool rotates freely.

13. The motorized hose reel according to claim 12 wherein the logic module is a programmable electronic device;

wherein the communication module is a wireless electronic communication device that allows the logic module to wirelessly communicate with the personal data device;

wherein the communication module establishes the wireless communication link between the control circuit and the personal data device.

14. The motorized hose reel according to claim 13 wherein the master switch is an electric switch;

wherein the master switch is a manually controlled switch;

wherein the master switch controls the flow of electric power from the power circuit into the relay circuit;

wherein the master switch disables the operation of the relay circuit to deploy and retract the hose;

wherein the master switch comprises a first lead and a second lead;

wherein the logic module controls the operation of the relay circuit;

wherein upon receipt of a first instruction from the personal data device through the communication module, the logic module configures the relay circuit to rotate the electric motor in the first direction in order to deploy the hose;

wherein upon receipt of a second instruction from the personal data device through the communication module, the logic module configures the relay circuit to rotate the electric motor in the second direction in order to retract the hose.

15. The motorized hose reel according to claim 14 wherein the relay circuit comprises a master relay and a dpdt relay;

wherein the logic module controls the operation of both the master relay and the dpdt relay;

wherein the master relay is a single pole single throw switch;

wherein the master relay forms an electrical connection between the master switch and the dpdt relay;

wherein the master relay controls the flow of electric power from the master switch into the dpdt relay;

wherein the logic module controls the master relay;

wherein the logic module closes the master relay in order to enable the operation of the electric motor;

wherein the logic module opens the master relay in order to disable the operation of the electric motor;

wherein the master relay comprises a third lead and a fourth lead;

wherein the dpdt relay is a double pole double throw switch;

wherein the dpdt relay forms an electrical connection between the master relay and the electric motor;

wherein the logic module controls the operation of the dpdt relay;

wherein the logic module shifts the position of the dpdt relay between a first electrical setting and a second electrical setting;

wherein by setting the dpdt relay in the first electrical setting while simultaneously setting the master relay to the closed position, the logic module causes the electric motor to rotate in the first direction;

wherein by setting the dpdt relay in the second electrical setting while simultaneously setting the master relay to the closed position, the logic module causes the electric motor to rotate in the second direction;

wherein the dpdt relay switch comprises a fifth lead, a sixth lead, a seventh lead, an eighth lead, a ninth lead, and a tenth lead.

16. The motorized hose reel according to claim 15 wherein the electric motor is an electrically powered device;

wherein the electric motor converts electrical energy received from the power circuit into rotational mechanical energy;

wherein the electric motor attaches directly to the spool structure such that the rotation of the electric motor rotates the spool of the spool structure;

wherein the electric motor comprises an eleventh lead and a twelfth lead.

17. The motorized hose reel according to claim 16 wherein the power circuit is an electrical circuit;

wherein the power circuit powers the operation of the control circuit;

wherein the power circuit is an electrochemical device;

wherein the power circuit comprises a battery, a diode, and a photovoltaic cell;

wherein the battery, the diode, and the photovoltaic cell are electrically interconnected;

wherein the battery comprises a first positive terminal and a first negative terminal;

wherein the photovoltaic cell comprises a second positive terminal and a second negative terminal.

18. The motorized hose reel according to claim 17 wherein the battery is a rechargeable battery;

wherein the photovoltaic cell is an electrical device that converts light into electrical energy;

wherein the photovoltaic cell is an electrical circuit that reverses the polarity of the rechargeable battery and provides the energy necessary to reverse the chemical processes that the rechargeable battery initially used to generate the electrical energy;

wherein the diode is an electrical device that allows current to flow in only one direction;

wherein the diode installs between the rechargeable battery and the photovoltaic cell such that electricity will not flow from the first positive terminal of the rechargeable battery into the second positive terminal of the photovoltaic cell.

19. The motorized hose reel according to claim 18 wherein the first lead of the master switch electrically connects to the first positive terminal of the battery;

wherein the second lead of the master switch electrically connects to the third lead of the master relay;

wherein the fourth lead of the master relay electrically connects to the fifth lead of the dpdt relay;

wherein the sixth lead of the dpdt relay electrically connects to the eleventh lead of the electric motor;

wherein the seventh lead of the dpdt relay electrically connects to the twelfth lead of the electric motor;

wherein the eighth lead of the dpdt relay electrically connects to the first negative terminal of the battery;

wherein the ninth lead of the dpdt relay electrically connects to the seventh lead of the dpdt relay;

wherein the tenth lead of the dpdt relay electrically connects to the sixth lead of the dpdt relay;

wherein the dpdt relay forms a set of electrical connections selected from the group consisting of: a) a first electrical setting that electrically connects the fifth lead to the sixth lead while simultaneously connecting the eighth lead to the ninth lead; and, b) a second electrical setting that electrically connects the fifth lead to the seventh lead while simultaneously connecting the eighth lead to the tenth lead;

wherein in the first electrical setting, electric power is routed to the electric motor such that the electric motor rotates in a first direction;

wherein in the second electrical setting, electric power is routed to the electric motor such that the electric motor rotates in a second direction that is the reverse of the first direction.

* * * * *